US005303873A

United States Patent [19]

Oe

[11] Patent Number: 5,303,873

[45] Date of Patent: Apr. 19, 1994

[54] WINDING SPEED CONTROL METHOD OF AUTOMATIC WINDER

[75] Inventor: Hideyuki Oe, Uji, Japan

[73] Assignee: Murata Kikai Kabushiki Kaisha, Kyoto, Japan

[21] Appl. No.: 945,027

[22] Filed: Sep. 15, 1992

[30] Foreign Application Priority Data

Sep. 17, 1991 [JP] Japan ..... 3-236291

[51] Int. Cl.[5] ..... B65H 54/40

[52] U.S. Cl. ..... 242/36; 242/18 R

[58] Field of Search ..... 242/36, 18 R, 18 DD, 242/35.5 R, 35.5 A, 35.6 R

[56] References Cited

U.S. PATENT DOCUMENTS 4,269,368 5/1981 Rapp et al. ..... 242/36 X
4,666,096 5/1987 Heel et al. ..... 242/36
4,765,552 8/1988 Sugioka et al. ..... 242/36 X
4,805,846 2/1989 Ueda et al. ..... 242/36
4,915,314 4/1990 Colli et al. ..... 242/36 X
4,984,749 1/1991 Matsui et al. ..... 242/36 X

*Primary Examiner*—Stanley N. Gilreath
*Attorney, Agent, or Firm*—Spensley Horn Jubas & Lubitz

[57] ABSTRACT

An inverter of a winding unit is controlled by preparing a plurality of kinds of acceleration instructions having different speed characteristics in the central control apparatus, selecting the sharpest acceleration instruction within the limit determined by generation of slip between drum and package, type of yarn and tension of yarn, etc. for each winding unit and transmitting the digital information thereof to the sequencer of the winding unit.

5 Claims, 3 Drawing Sheets

WINDING SPEED CONTROL METHOD OF AUTOMATIC WINDER

BACKGROUND OF THE INVENTION

1. Field of the Invention

The present invention relates to a winding speed control method of an automatic winder.

2. Related Art Statement

In an automatic winder comprising a plurality of winding units, each winding unit is provided with an inverter which controls the starting, the stopping and the rotating speed of a drum for driving a package to thereby control the speed at which yarn is wound on the package. In a conventional automatic winder, the acceleration of the drum during the start up time of the winding unit is initially fixed and cannot be changed. It is assumed that by increasing the acceleration of the drum at the start up time as sharply as possible, the start up time may be shortened and the efficiency of the machine may be improved.

OBJECT AND SUMMARY OF THE INVENTION

It is an object of the present invention to provide a winding speed control method for an automatic winder which improves machine efficiency by increasing the sharpness of the acceleration of the drum of the winding unit at the start up time.

To achieve this objective, a winding speed control method in accordance with the present invention controls an inverter of the winding unit by preparing a plurality of acceleration instructions having different acceleration characteristics in a central control apparatus common to many winding units, selecting an acceleration instruction having the sharpest acceleration within limits determined by the generation of slip between the drum and the package, the type of yarn, the tension of the yarn, etc. for each winding unit, and then transmitting the instruction digitally to a sequencer of the winding unit.

A sharp acceleration is generally desirable for the winding unit, but if the acceleration becomes too sharp, the yarn will break due to the generation of slip between the package and the drum (depending upon the type of yarn and the tension of the yarn, etc.). Therefore, the acceleration instruction which is sharpest within the limit for not generating such breakage phenomenon is selected from the plurality of acceleration instructions and is then transmitted to control the inverter of the winding unit. Thereby, the optimal acceleration characteristic may be set for each winding unit depending on conditions such as differences in package diameter, etc., and the start up time can be shortened thereby improving machine efficiency.

DETAILED DESCRIPTION

A preferred embodiment of the present invention will be explained with reference to the accompanying drawing.

Figure 1:
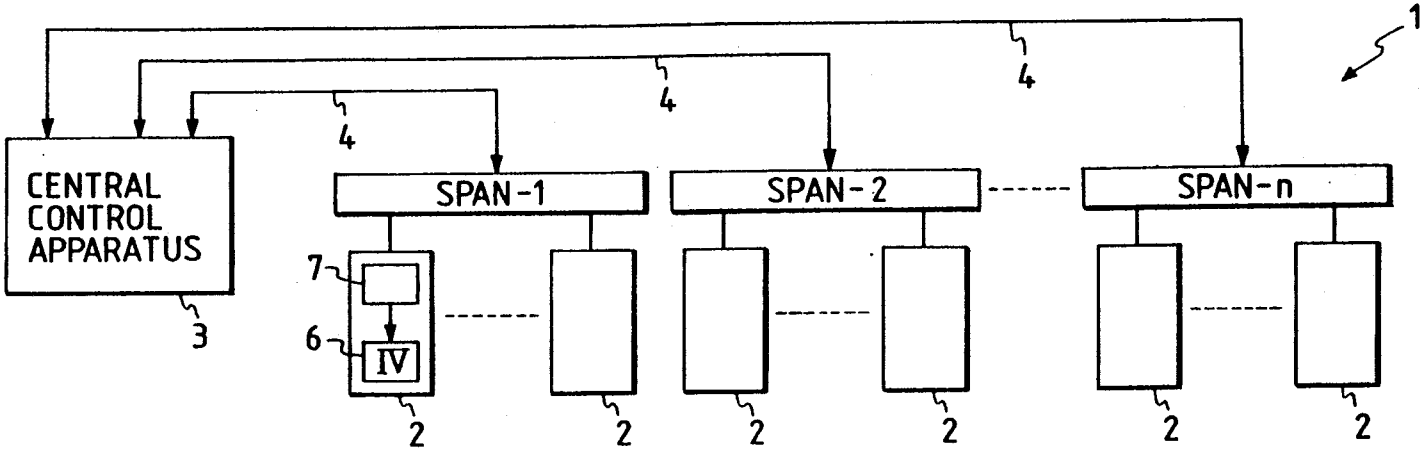
FIG. 1 illustrates a schematic diagram of a control system to which a winding speed control method in relation to an embodiment of the present invention is applied.

In FIG. 1, the numeral 1 denotes an automatic winder consisting of many winding units 2 provided in parallel. Usually, a plurality of automatic winders are arranged in a factory and each automatic winder is respectively provided with a yarn end finding apparatus CBF of yarn supply bobbin (continuous automatic bobbin feeding apparatus) and an automatic doffer (AD) of package not illustrated. These many winding units 2 are grouped into SPAN-1, SPAN-2, . . . , SPAN-n and are connected with a central control apparatus 3 located at the one end of the automatic winder 1 through a communication line 4. More specifically, winding units 2 and the central control apparatus 3 are connected with each other through serial communication apparatuses 5, 5 (FIGS. 2, 3).

Figure 2:
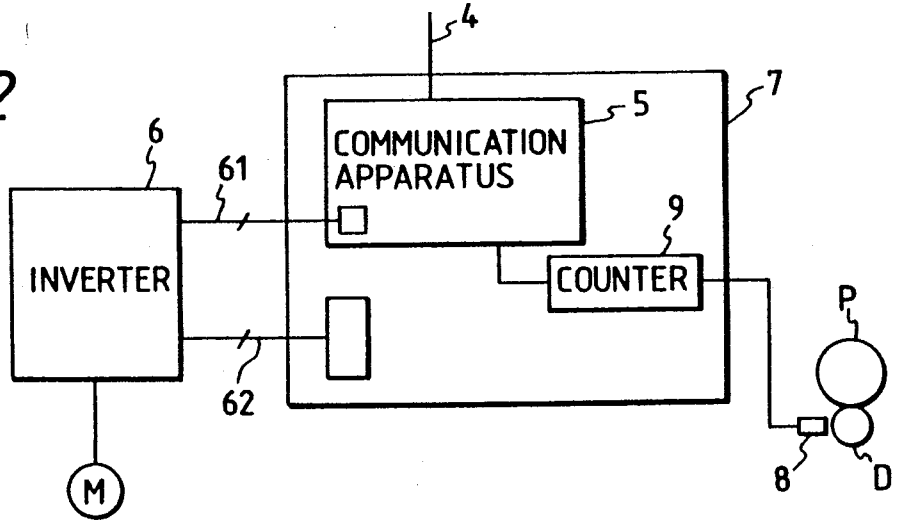
FIG. 2 illustrates a schematic diagram indicating a structure of a winding unit.

In FIG. 2, a winding unit 2 is provided, for each spindle, with an inverter 6 for rotating a drive motor M of a drum D which drives a winding package P and a sequencer 7 for controlling operation of this inverter 6 and transmitting various data in the side of winding unit. Moreover, a sensor 8 for sensing rotating speed of the drum D is also provided and the pulses detected by the sensor is counted by a counter 9 to detect rotating speed of the drum D. The winding unit 2 is provided additionally with an ordinary yarn clearer and a yarn splicing apparatus.

In this embodiment, the central control apparatus 3, for each unit, sets various data including yarn winding length to package and the number of times of rewinding due to defective yarn splicing, detects the operating conditions and simultaneously sets various setting values. Moreover, this central control apparatus 3 also has the function of generating an acceleration instruction to the inverter 6.

Figure 3:
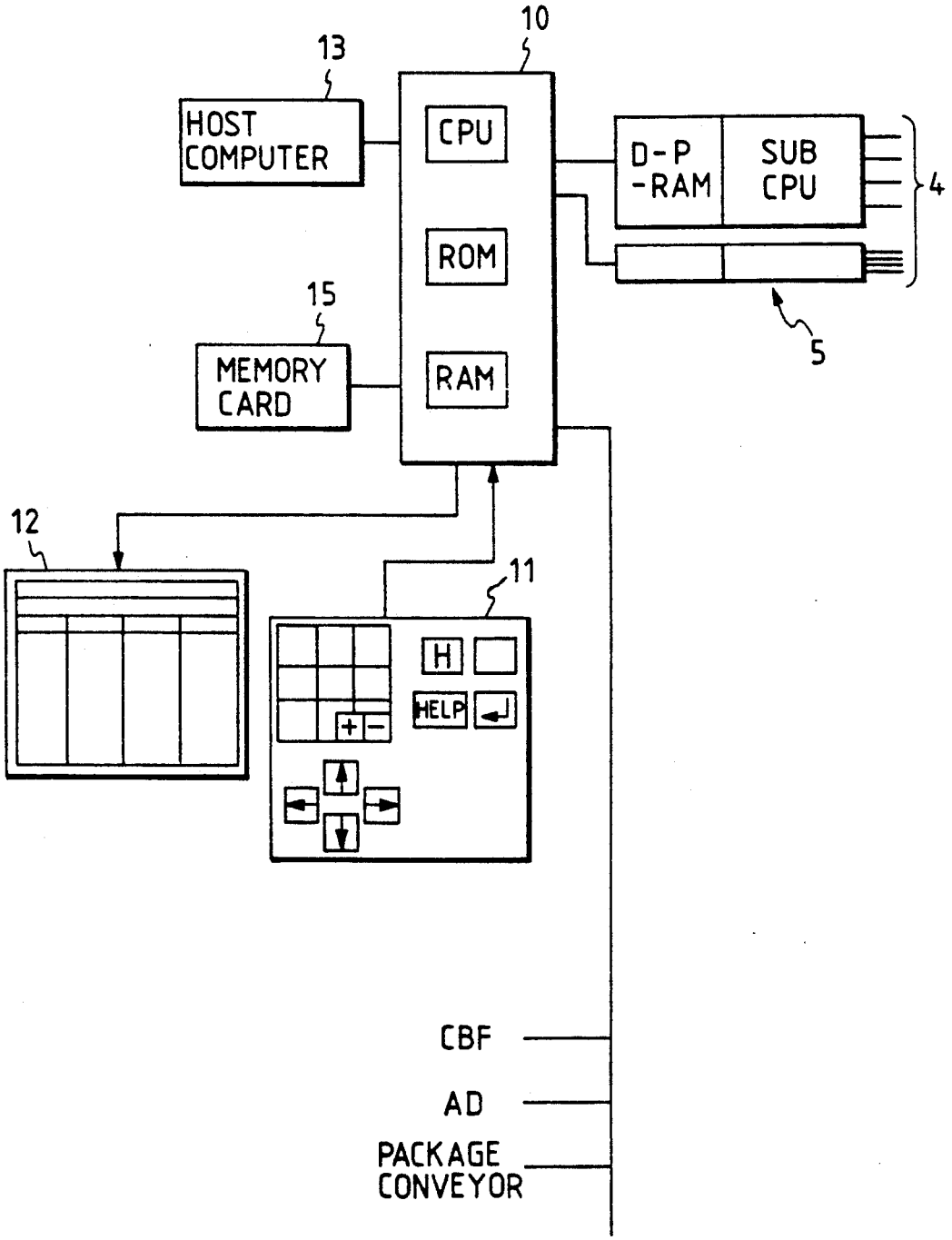
FIG. 3 illustrates a schematic diagram indicating a structure of a central control apparatus.

FIG. 3 illustrates a structure of the central control apparatus 3 which is mainly composed of a microcomputer 10 including RAM and ROM and also comprises a graphic display 12 consisting of a keyboard 11 and a liquid crystal display LCD, a host computer 13, and a memory card 15, etc. The sequencer 7 of each winding unit 2 is connected with the,, microcomputer 10 by a communication line 4 through a communication apparatus 5 consisting of sub-CPU and D-P-RAM to conduct operation control and data collecting with serial communication. An acceleration control instruction to each winding unit 2, an instruction for switching of screen in the graphic display 12 and an instruction for display content are issued from the keyboard 11.

Figure 4:
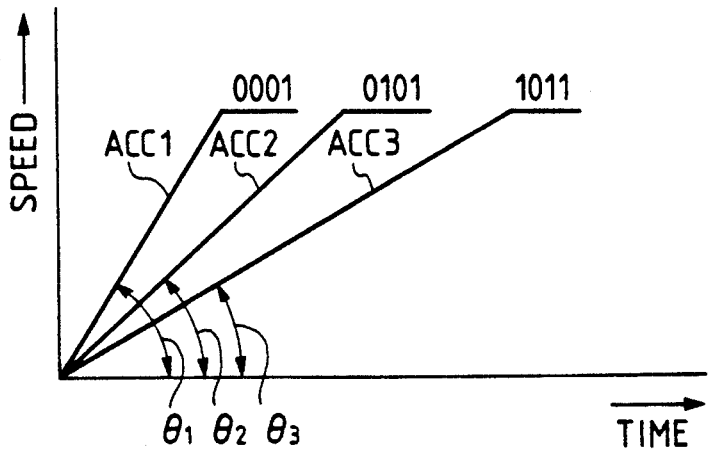
FIG. 4 illustrates a diagram indicating three kinds of acceleration characteristics in relation to an embodiment of the present invention.

The acceleration control instruction applied to each winding unit 2 from the central control apparatus 3 is issued for the acceleration characteristic at the time of accelerating a drive motor M of drum D which drives the winding package P. As illustrated in FIG. 4, only one characteristic is selected by the keyboard 11 from three kinds of adequate acceleration characteristics ACC1, ACC2, ACC3 considering type of yarn and tension of yarn, etc., and the acceleration instructions are serially transmitted to the sequencer 7 of the winding unit 2 through the communication apparatus 5 with the codes 0001, 0101, 1011. In this case, the acceleration characteristics ACC1, ACC2, ACC3 respectively show gradual rising in this sequence, and the inclination angles $\theta_1$, $\theta_2$, $\theta_3$ of accelerating portions can be varied with an input instruction from the keyboard 11 in the side of the central control apparatus 3. The sequencer 7 in the side of winding unit 2, without changing it in any way, applies the received acceleration instruction to the inverter 6 in the form of parallel signal with a line 62 to increase the rotating frequency of the inverter 6 depending on the acceleration characteristic. The line 61 is a serial line for controlling start and stop of the inverter 6.

As described above, the number of rotations of package of the winding unit 2 is controlled to the adequate acceleration characteristic within the limit determined by generation of slip between drum and package, type of yarn and tension of yarn, etc. by applying the acceleration instruction from the central control apparatus 3 in order to control operation of the inverter 6.

In this embodiment, only one characteristic is selected by the keyboard input from three kinds of acceleration characteristics ACC1, ACC2, ACC3, but it is also possible to automatically select the one characteristic with the central control apparatus 3 depending on the package diameter and use such characteristic for start control such as start of drum after the yarn splicing. A value of package diameter can be calculated indirectly, for example, from the winding length of package P and rotating speed of winding.

As described above, the present invention selects an acceleration instruction having the sharpest rising portion from a plurality of acceleration instructions within a limit not generating inconvenience such as slip between drum and package and cutting of yarn and controls the inverter of the winding unit by transmitting such acceleration instruction, thereby enabling that adequate and sharp acceleration characteristic to be obtained and depending on the absence of slip and breakage of yarn, the rising time of winding unit is shortened and machine efficiency is improved.

What is claimed is:

1. In an automatic winder comprising a plurality of winding units, each of the winding units having a drum for driving a winding package and a drum control means for controlling rotation of the drum, a winding speed control method comprising:

providing a common control unit for the plurality of winding units, providing a plurality of acceleration instructions in the control unit corresponding to a plurality of different drum accelerations, selecting an acceleration instruction for each of the winding units, and transmitting the selected acceleration instruction to the drum control means of the winding unit.

2. The method of claim 1, comprising:

defining a range of accelerations for the drum of each winding unit that will enable the winding package to be wound by the winding unit without yarn breakage, the range having a maximum acceleration, and wherein the step of selecting an acceleration instruction comprises selecting an acceleration instruction corresponding to the maximum acceleration within the defined range.

3. The method of claim 1, wherein the winding package on each winding unit defines a diameter, and further comprising the step of determining the diameter of the winding package on a winding unit, and selecting an acceleration instruction depending on the package diameter.

4. The method of claim 1, comprising the step of sensing the rotating speed of the drum.

5. The method of claim 1, comprising:

providing a microcomputer comprising RAM, ROM, a graphic display, a host computer, a memory, a memory card and a keyboard for issuing acceleration instructions, and providing a communication apparatus for connecting the microcomputer to the drum control means of each winding unit.

* * * * *